US005572243A

United States Patent [19]

Hermanson

[11] Patent Number: 5,572,243

[45] Date of Patent: Nov. 5, 1996

[54] INK JET PRINTER PRIMING ELEMENT

[75] Inventor: Herman A. Hermanson, Penfield, N.Y.

[73] Assignee: Xerox Corporation, Stamford, Conn.

[21] Appl. No.: 200,605

[22] Filed: Feb. 23, 1994

[51] Int. Cl.[6] ..... B41J 2/165

[52] U.S. Cl. ..... 347/29; 347/30

[58] Field of Search ..... 347/22, 29, 30

[56] References Cited

U.S. PATENT DOCUMENTS

| | | | |
|---|---|---|---|
| 4,567,494 | 1/1986 | Taylor | 347/30 |
| 4,728,970 | 3/1988 | Terasawa | 347/30 |
| 4,881,085 | 11/1989 | Gibson et al. | 347/30 |
| 4,947,191 | 8/1990 | Nozawa et al. | 347/30 |
| 4,952,947 | 8/1990 | Kyoshima | 347/30 |
| 4,998,115 | 5/1991 | Nevarez et al. | 347/35 |
| 5,040,000 | 8/1991 | Yokoi | 347/30 |
| 5,055,856 | 10/1991 | Tomii et al. | 347/30 |
| 5,138,334 | 8/1992 | Rowe et al. | 347/25 |
| 5,164,748 | 11/1992 | Katayanagi et al. | 347/30 |
| 5,210,550 | 5/1993 | Fisher et al. | 347/30 |
| 5,250,962 | 10/1993 | Fisher et al. | 347/32 |
| 5,359,358 | 10/1994 | Shimamura et al. | 347/9 |

FOREIGN PATENT DOCUMENTS

| | | |
|---|---|---|
| 62-271749 | 9/1987 | Japan . |
| 2118429 | 1/1992 | Japan . |

*Primary Examiner*—John E. Barlow, Jr.
*Attorney, Agent, or Firm*—Daniel J. Krieger

[57] ABSTRACT

A priming element for priming or maintaining the nozzles or orifices of an ink jet printhead in an ink jet printer. The priming element applies a vacuum or negative pressure generated by a suction device to the nozzles. The priming element includes a first wall and a second wall spaced from the first wall to define a passageway between the first wall and the second wall. One or more support members connect the first wall to the second wall and span the passageway to prevent the walls of the priming element from collapsing from the applied vacuum or negative pressure.

14 Claims, 5 Drawing Sheets

INK JET PRINTER PRIMING ELEMENT

FIELD OF THE INVENTION

This invention relates generally to maintenance stations for ink jet printing apparatus and more particularly to vacuum priming of thermal ink jet nozzles.

BACKGROUND OF THE INVENTION

An ink jet printer of the so-called "drop-on-demand" type has at least one printhead from which droplets of ink are directed towards a recording medium. Within the printhead, the ink may be contained in a plurality of channels where power pulses are used to cause the droplets of ink to be expelled, as required, from orifices or nozzles at the ends of the channels.

In a thermal ink jet printer, the power pulses that result in a rapidly expanding gas bubble to eject the ink from the nozzle are usually produced by resistors, each located in a respective one of the channels, which are individually addressable by voltage pulses to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The nozzles in each printhead are aligned perpendicular to the line of movement of the carriage and a swath of information is printed on the stationary recording medium as the carriage is moved in one direction. The recording medium is then stepped, perpendicularly to the line of carriage movement, by a distance equal to the width of the printed swath. The carriage is then moved in the reverse direction to print another swath of information.

It has been recognized that there is a need to maintain the ink ejecting nozzles of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles and also periodically to maintain proper functioning of the nozzles. Maintenance and/or priming stations for the printheads of various types of ink jet printer are described in, for example, U.S. Pat. No. 4,855,764; 4,853,717 and 4,746,938 while the removal of gas from the ink reservoir of a printhead during printing is described in U.S. Pat. No. 4,679,059.

It has been found that before the printing operation begins it is necessary to draw ink through the printhead nozzles to thereby fill the channels and nozzles with ink so that printing can begin with accurate placement of the ejected ink upon the medium. It has also been found that under certain conditions the ink channels or nozzles will become clogged with debris or with dried ink. In such a situation, the printhead must be primed to remove the unwanted material by vacuum priming. In vacuum priming, a priming element is placed against the face of a printhead to cover the nozzles. A vacuum is applied to the nozzles through the priming element and ink is drawn from the printhead, through the priming element, and to a waste container. The priming element is typically made of a flexible and resilient material such as rubber.

In U.S. Pat. No. 4,567,494 to Taylor, a nozzle cleaning and priming apparatus for thermal ink jet printers is described. A hollow cylindrical suction cup includes a drain pipe for connection to a suction tube. A second cup made of foam is positioned within the hollow of the cup. The suction tube pulls ink from the printhead and through the foam cup under the application of a vacuum.

U.S. Pat. No. 4,881,085 to Gibson et al. describes a manually operated cleaning tool for use in a liquid ink jet printing apparatus. A vacuum head is used to remove excess printing liquid from the exposed face of an orifice plate. The vacuum head includes a solid vacuum block which has a fluid receiving chamber. An elastomeric member is bonded to the inside surface of the fluid chamber.

U.S. Pat. No. 4,947,191 to Nozawa et al. describes an ink jet recording apparatus including a capping unit for covering the plural discharging openings for an ink jet head and suction means for sucking ink from the discharging openings through the capping means.

U.S. Pat. No. 4,952,947 to Kyoshima describes an ink discharge recovery device having a cap capable of covering a recording liquid discharge surface and a suction means for sucking ink and/or air from the plurality of discharge openings through the cap.

U.S. Pat. No. 5,040,000 to Yokoi describes an ink jet recording apparatus having an ink recovery system. The ink recovery system includes a cap member for suction recovery, a suction pump for sucking, a cleaning member for cleaning a discharge sur-face of a recording head and a driving member for driving the cleaning member.

U.S. Pat. No. 5,055,856 to Tomii et al. describes a capping device for an ink jet printer. The ink capping device includes a cap for sealing the ink outlet portion of an ink jet printhead, a suction device for maintaining a proper ink level within the printhead and a valve to regulate pressure within the print head.

U.S. Pat. No. 5,138,334 to Rowe et al. describes an arrangement for cleaning the face of ink jet printhead. A suction chamber is directed towards but spaced apart from the the printhead face to draw air over the printhead face to remove contamination such as ink and paper fibers.

U.S. Pat. No. 5,164,748 to Katayanagi et al. describes a suction recovery device with a cap having a communicating member to aid suction. The suction recovery device includes a cap having an ink suction portion and an ink exhaust path communicating with the ink suction port.

U.S. Pat. No. 5,210,550 to Fisher et al. describes a maintenance station for an ink jet printer. The maintenance station provides for priming of the printhead as well as maintaining a humid environment to prevent ink from drying out in the printhead orifices. A resilient seal means with lips contacts the printhead face during priming and cleaning.

U.S. Pat. No. 5,250,962 to Fisher et al. describes a movable priming station for use with an ink jet printer. The movable priming station includes a vacuum port. The vacuum port can be provided with a suction tip which can be oval shaped.

Japanese Publication No. 62-271749 describes a seal cap having a cavity wall having a recessed part capable of holding a recording liquid. Under a capped condition, the seal cap prevents ink coagulation at an ink ejecting port.

One problem encountered with many prior priming stations is that fluid-tight sealing between the stations and the printhead faces containing the droplet ejecting orifices causes high negative pressures within the priming stations under the application of a vacuum to prime or clean the droplet ejecting orifices. Such an arrangement can cause the collapse of certain elements of the priming station or may necessitate the use of a vacuum which supplies less negative pressure than desirable for the priming or cleaning of droplet ejecting orifices. The priming element of the present invention is less susceptible to collapse under the application of negative pressures typically used for ink jet nozzle priming or cleaning and allows for the application of increased negative pressure to a printhead for priming and cleaning.

SUMMARY OF THE INVENTION

In accordance with one aspect of the present invention, there is provided a priming element having a first wall member and a second wall member spaced a distance from the first wall member which together define a passageway between the first and second wall members. Support means connect the first wall member to the second wall member and span the passageway to maintain the passageway in an open condition.

Pursuant to another aspect of the invention, there is provided a thermal ink jet printer having a priming element including a first wall member and a second wall member in which the first wall member is spaced a distance from the second wall member which together define a passageway between the first and second wall members. Support means connect the first wall member to the second wall member, and span the passageway to maintain the passageway in an open condition.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
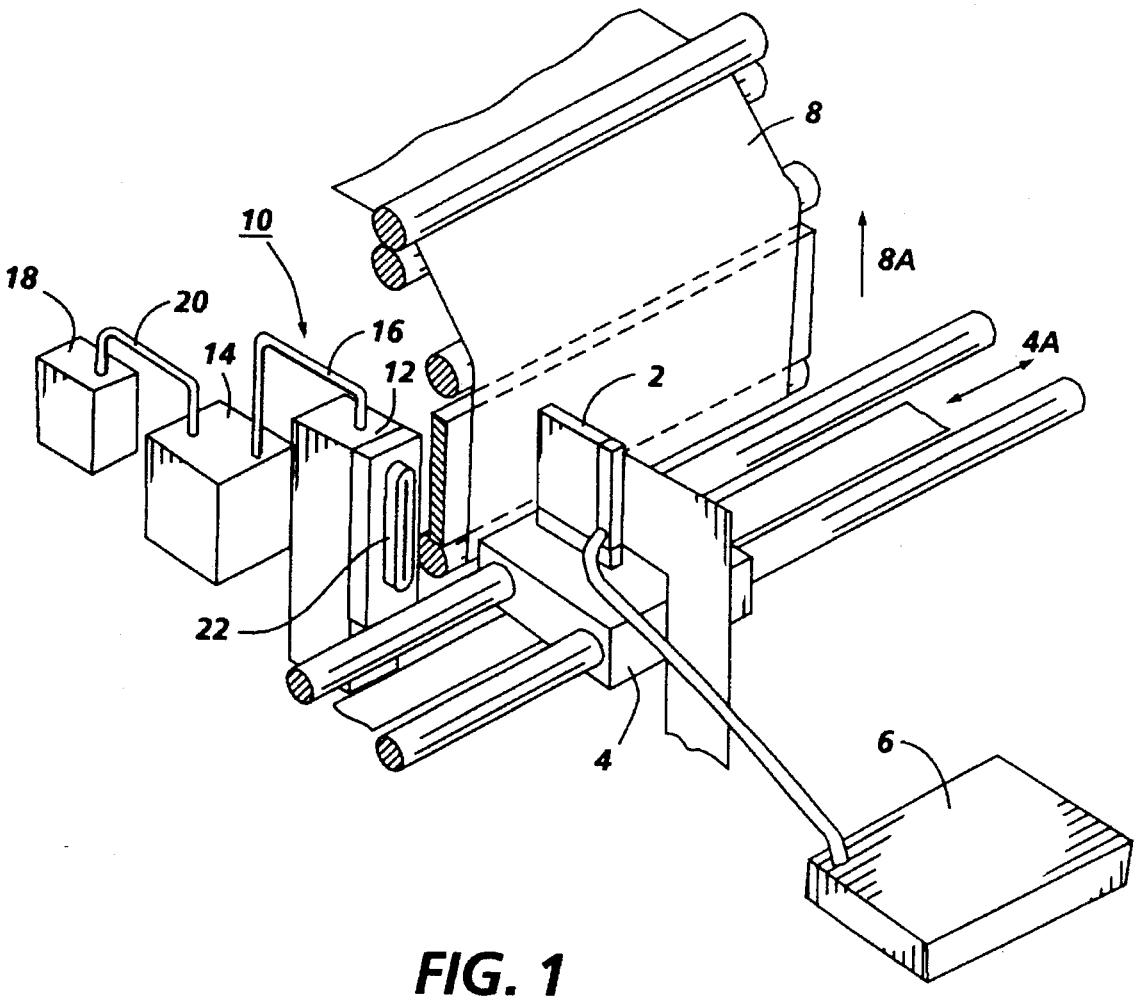
FIG. 1 is a schematic perspective view of a thermal ink jet printer.

The printer shown in FIG. 1 has a printhead 2 mounted on a carriage 4 connected to receive ink from a supply container 6. The printhead 2 contains a plurality of ink channels (not shown in FIG. 1) which carry ink from the supply container 6 to respective ink ejecting orifices or nozzles (also not shown in FIG. 1). When printing, the carriage 4 reciprocates back and forth across the page as indicated by the arrow 4A. Droplets of ink are expelled from selected ones of the printhead nozzles in the manner previously described and are directed towards a recording medium 8 which can be a cut sheet of paper, a web of paper, or other material which can receive ink from the printhead 2. During each pass of the carriage 4, the recording medium 8 is stationary. At the end of each pass, however, the recording medium 8 is stepped in the direction of the arrow 8A. For a more detailed explanation of the printhead and printing thereby refer to U.S. Pat. No. 4,571,599 and U.S. Pat. No. Reissue 32,572 incorporated herein by reference.

At one side of the printer outside the printing zone is a priming/maintenance station 10. At the completion of a printing operation, the printhead carriage 4 is parked in a location nearby the priming maintenance station 10. The priming maintenance station 10 includes a capping member 12 which is coupled to an ink trap 14 through a first line 16. The ink trap 14 is coupled to a suction pump 18 through a second line 20. The suction pump 18 applies a negative pressure or a vacuum to the capping member 12 through the lines 20, 16 and also through the ink trap 14. The ink trap 14 traps any ink or other debris which is drawn by the capping member 12 during a priming or maintenance operation.

When the carriage 4 is parked in front of the priming/maintenance station 10, the capping member 12 is moved towards the printhead 2 until the priming element 22, which is coupled to the capping member 12, contacts the printhead 2. Once in contact, the priming element 22 fits tightly against the front face of the printhead 2, thereby surrounding the ink ejecting orifices.

Figure 2:
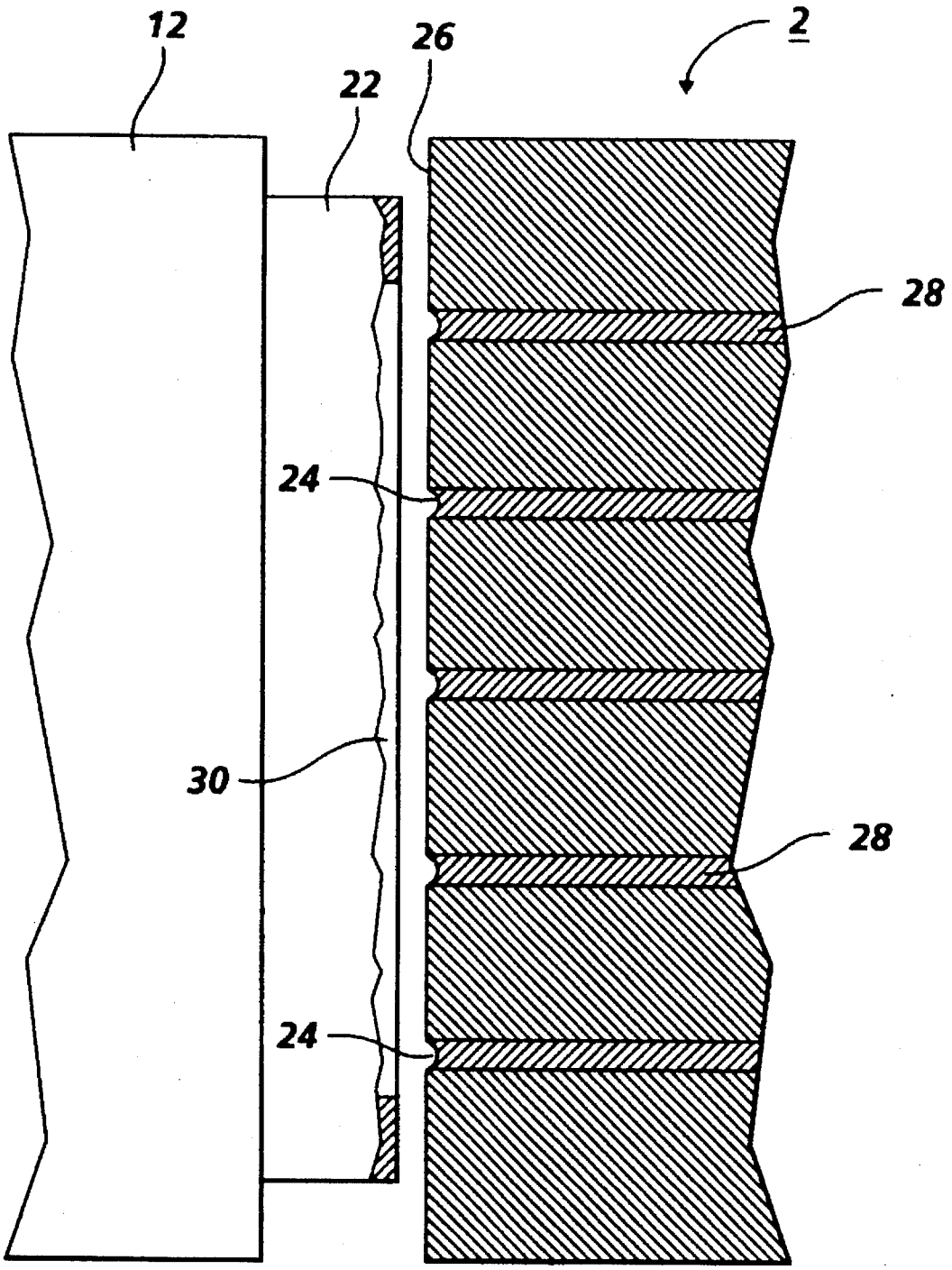
FIG. 2 is a diagrammatic sectional elevational view showing part of a printhead and a priming/maintenance station of the FIG. 1 thermal ink jet printer.

This situation is illustrated in FIG. 2 in which a plurality of nozzles or orifices 24 of the printhead 2 are located along the front face 26 thereof and connected to a plurality of ink carrying channels 28. An actual printhead can include many nozzles in a linear array aligned perpendicularly to the direction of reciprocation indicated by the arrow 4A in FIG. 1. The priming element 22 is pressed against the front face 26 of the printhead 2 thereby surrounding each of the nozzles 24. FIG. 2 shows a portion of the priming element 22 cut away and also spaced away from the printhead 2 for illustration purposes. Before printing commences, the pump 18 is operated to apply suction to a passageway 30 within the priming element 22 to thereby draw some amount of ink or debris from the printhead nozzles 24. In that way, any dry ink or air bubbles are removed. Other features of the priming element 22, partially illustrated in FIG. 2, will become more apparent as illustrated in FIGS. 3 through 6.

The priming/maintenance station 10 is also used to prime to printhead 2 after a new ink supply container 6 has been installed. In this situation, when the priming element 22 is positioned in contact with the front face 26 of the printhead 2, the suction pump 18 operates to draw all air out of the printhead 2 through the nozzles 24 and the channels 28 thereby insuring that the printhead 2 is full of ink before any printing begins. The maintenance station can also be used to apply suction to the nozzles 24 to clear the nozzles 24 during a printing operation, if a deterioration in print quality should become apparent.

Operation of the suction pump 18 is used to draw air and also ink through the priming element 22 through the line 16. The ink drawn from the printhead 2 is held in the ink trap 14, thereby preventing the suction pump 18 from receiving ink which could cause a malfunction therein. Typically, the operation of the suction pump 18 is terminated before the priming element 22 is withdrawn from the printhead 2. Droplets of ink may then remain on the front face 26 of the printhead which if allowed to remain may affect print quality. This excess ink may be removed by vacuum removal methods, wiping methods or other known methods. Likewise, the front face 26 may also become contaminated with paper fibers or other foreign material during an operation and may likewise affect print quality.

Figure 3:
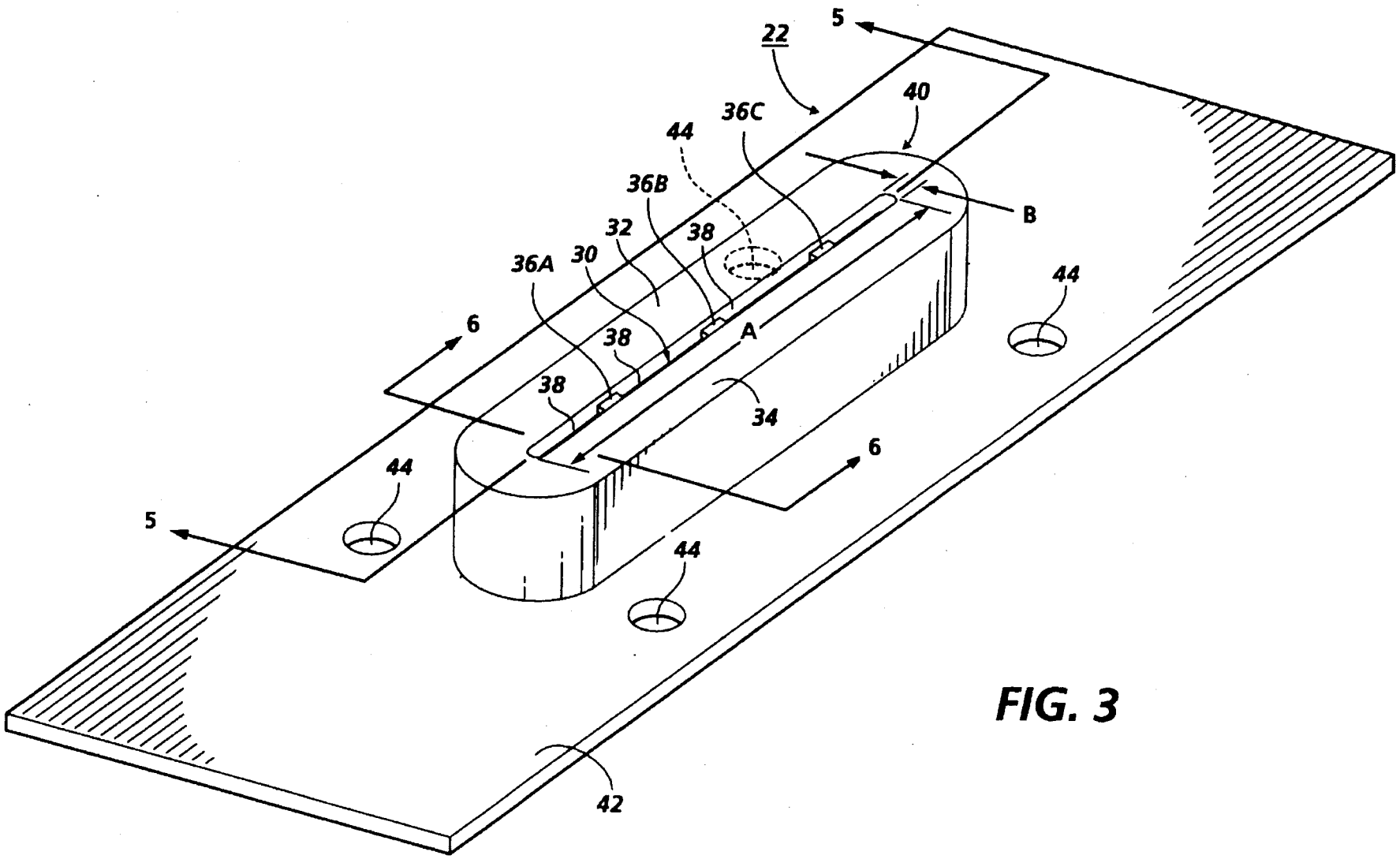
FIG. 3 is a perspective view of one side of a priming element of the present invention.

FIG. 3 illustrates the priming element 22 of the present invention. As previously described, the priming element 22 removes debris and ink from the nozzles 24 by drawing a vacuum through the passageway 30. Typically, a vacuum on the order of 65–140 inches of water is used. The passageway 30 extends through the entire priming element 22 and is connected to the suction pump 18 through the lines 16 and 20 and the ink trap 14. The priming element 22 includes a first wall 32 and a second wall 34 which are separated by a predetermined distance. The inside surfaces of the first wall 32 and the second wall 34 are substantially parallel. In the embodiment shown in FIG. 3, the first wall 32 and the second wall 32 meet at each end thereby closing off the ends of the priming element 22 to maintain a proper vacuum for priming/maintenance of the nozzles. The first wall 32 and the second wall 34 can, however, be discrete elements the ends of which can be connected by other means to define the passageway for drawing a vacuum. For instance, end walls perpendicular to the first wall and second wall and defining the passageway are also possible.

It has been found that in the prior art, the first wall 32 and the second wall 34, under the application of a vacuum, can collapse upon each other under the application of a vacuum thereby closing off the passageway 30 which in turn prevents proper application of a vacuum to the front face 26 of the printhead. To prevent the passageway 30 from closing under the application of a vacuum, one or more support members 36 are placed across the passageway 30 to connect the inner surfaces of the first wall 32 and the second wall 34. By spanning the passageway 30, one or more support members 36 prevent the passageway 30 from closing under the application of a vacuum. As illustrated in FIG. 3, a first support member 36A, a second support member 36B, and a third support member 36C span the passageway. Each one of the plurality of support members 36A, B and C are spaced a distance from an adjacent support member 36 thereby defining a space 38 therebetween. Support members located closest to the end of the walls of the priming element 22 also define a space.

FIG. 3 also shows that support members 36A, 36B and 36C are slightly recessed a predetermined distance from the top surface of the first wall 32 and the top surface of the second wall 34. The recessing of the support members 36 is more apparent in FIGS. 5 and 6 to be discussed later.

The passageway 30 defined by the first wall and the second wall 32 and 34, respectively, has a length A. The length A is sufficiently long to encompass an entire linear array of nozzles in the present application. A width B of the passageway 30 defined by the first wall and the second wall 32 and 34, respectively, is on the order of approximately 0.025 inches wide which is only somewhat larger than the width of the linear array of nozzles. As shown in FIG. 3, the first wall 32 and the second wall 34 are formed of a single member 40 which extends away from a skirt or apron 42 attached thereto. The skirt 42 is a substantially flat or planar sheet of elastic and resilient material having mounting holes 44 which allows for proper attachment of the priming element 22 to the capping member 12.

Figure 4:
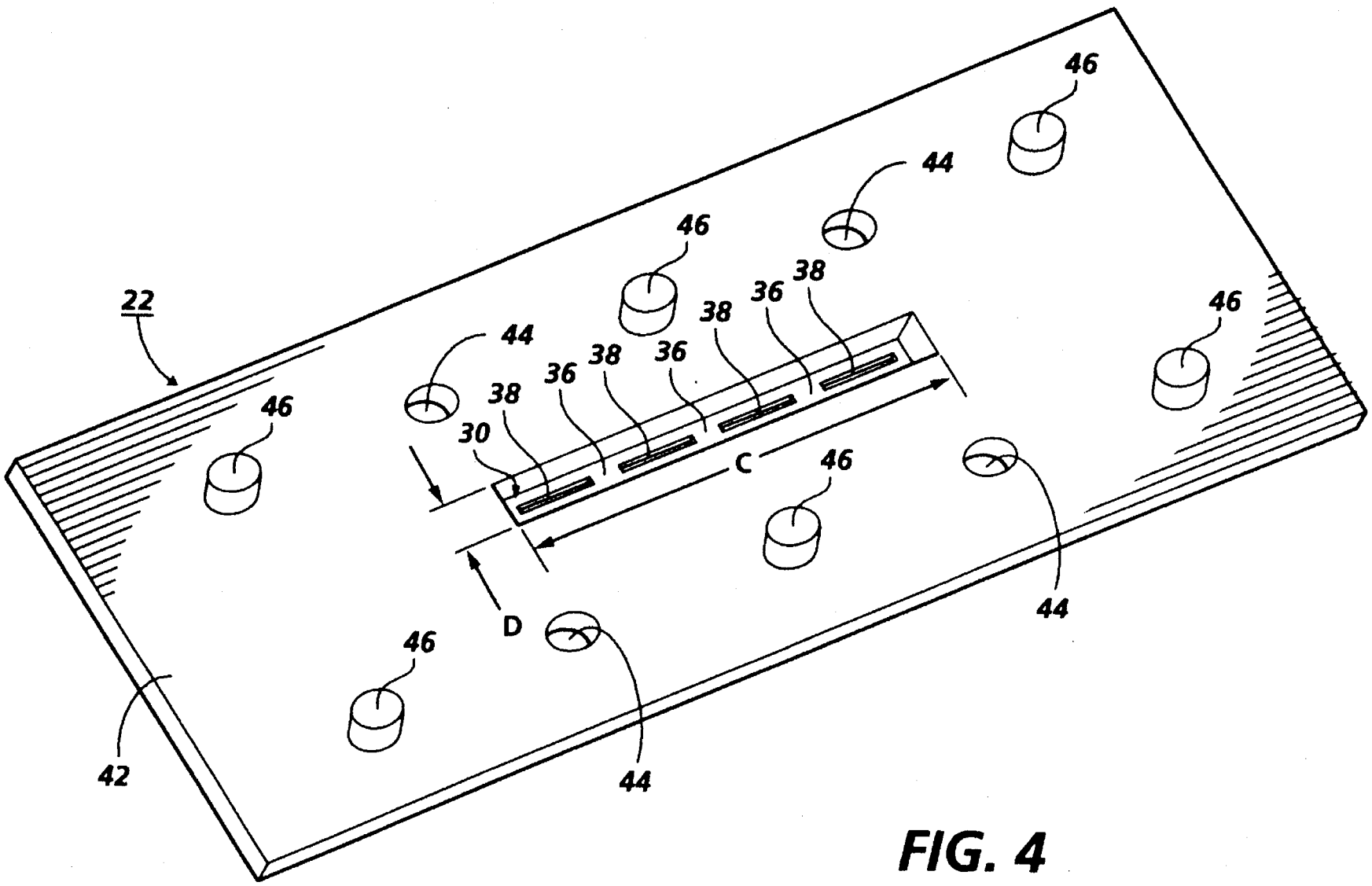
FIG. 4 is a perspective view of the opposite side of the priming element illustrated in FIG. 3.

FIG. 4 illustrates the opposite side of the priming element 22 illustrated in FIG. 3. As seen in FIG. 4, the opposite side of the apron 42 includes a plurality of mounting protrusions 46. The mounting protrusions 46 and the holes 44 provide a structure for mounting the priming element 22 to the capping member 12. Other structures are also possible as is known by those skilled in the art. It is also possible to devise a priming element 22 which includes only the first wall 32 and the second wall 34 and does not include the skirt 42. As previously described, the passageway 30 defined by the first wall and the second wall continues through the priming element 22. It can be seen, however, as illustrated in FIG. 4 that the passageway 30 becomes larger at this point than the passageway previously described in FIG. 3 having a length A and a width B. The passageway 30 is made larger by increasing the length, here shown as a distance C, to a length greater than the distance A of the passageway 30 of FIG. 3. Additionally, the passageway 30 has a width of a distance D which is greater than the distance B.

Figure 5:
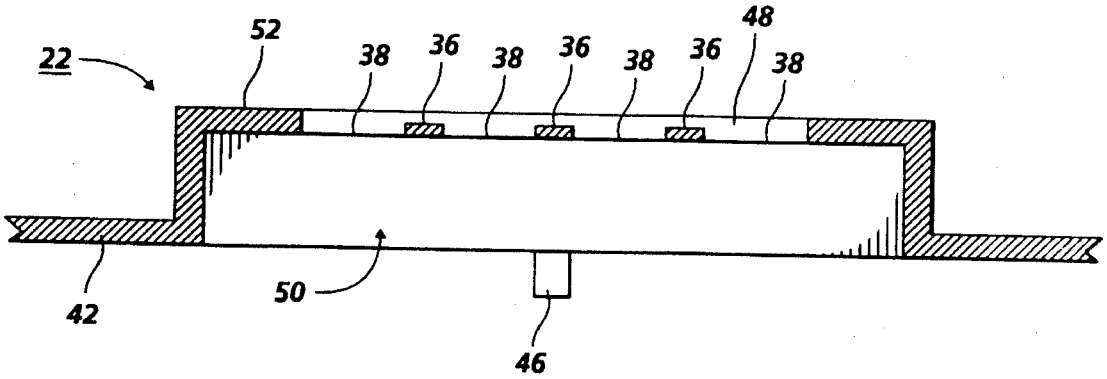
FIG. 5 is a sectional elevational view of the priming element of FIG. 3 taken along line 5—5 in the direction of the arrows.

The difference in size of the passageway 30 can be more easily seen in FIG. 5 illustrating a sectional elevational view along a line 5—5 of FIG. 3. A first cavity 48, defined as being above the support members 36 having the length A and the width B shown in FIG. 3, is smaller than a second cavity 50, defined as being on the opposite side of the support members 36, having the length C and width D shown in FIG. 3. By recessing the support members 36 beneath a top surface 52 of the priming element 22 obstruction of any of the nozzles 24 during a priming operation by the support members is prevented. Because the top surface of the priming element 22 must be a continuous opening to adequately prime and maintain the nozzles, the support members 36 are recessed below the top surface 52. A recess equal to the opening width B of 0.025 inches is adequate.

In another embodiment, the chamber 50 located below the support members 36 could have the same length A and width B of the first chamber 48. It has been found, however, by expanding the volume of the chamber 50 located below the support members 36 by increasing the overall width and overall length that any possibility of closure of the chamber 50 under the application of a vacuum is thereby prevented.

Figure 6:
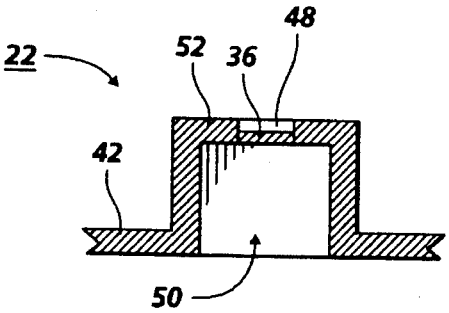
FIG. 6 is a sectional elevational view of the priming element of FIG. 3 taken along a line 6—6 in the direction of the arrows.

FIG. 6 illustrates a sectional elevational view of the priming element 22 along a line 6—6 of FIG. 3. FIG. 6 illustrates the arrangement of the first cavity 48 and the second cavity 50 with respect to the support members 36. In particular, it can be seen that the support member 36 is offset away from the top surface 52 and that the cavity 50 is larger than the cavity 48.

In recapitulation, a priming element for a thermal ink jet printhead having non-collapsible features is described. It is therefore apparent that there has been provided in accordance with the present invention a priming element less susceptible to collapse under the application of a vacuum. The priming element of the present invention allows for increased negative pressure and therefor better priming and/or maintenance of the printhead nozzles. The present invention can be molded of a single piece made of rubber or some other manmade material which has elastic and resilient properties.

While the invention has been described in conjunction with a specific embodiment thereof, it is evident that many alternatives, modifications and variations will be apparent to those skilled in the art. For instance, it is possible that the inside surfaces of the first wall 32 and the second wall 34 defining the chamber 48 are not substantially parallel to one another but are angled with respect to one another. Likewise, it is also possible that the inside surface of the first wall and the second wall forming the chamber 50 are not substantially parallel to one another but can take on other forms within the scope of this invention. Further embodiments are also possible depending on the length of the linear array of nozzles which are to be primed.

Because the present invention includes support members which prevent the priming element from collapsing under the force of an applied vacuum, the present invention can accommodate linear arrays of nozzles of any length including those of a full width array. In addition, the width B of the priming element 22 could be increased to accommodate two-dimensional arrays of nozzles. Consequently, the support members 36 can range anywhere from a single support member to a multitude of support members which are spaced along the priming element 22 to prevent the collapse thereof. Accordingly, the present invention is intended to embrace all such alternatives, modifications and variations that fall within the spirit and broad scope of the appended claims.

I claim:

1. A priming element comprising;

a first wall member defining a contacting surface;

a second wall member spaced a distance from said first wall member, said first wall member and said second wall member together defining a passageway therebetween; and support means recessed from the contacting surface, connecting said first wall member to said second wall member, wherein said support means comprises a plurality of spaced apart support members, each of said plurality of support members spanning the passageway and connecting said first wall member to said second wall member to maintain the passageway in an open condition, thereby permitting the flow of material therethrough.

2. The priming element of claim 1, wherein said second wall member defines a second contacting surface said plurality of support members being recessed from the second contacting surface.

3. The priming element of claim 2, wherein said first wall member, said second wall member, and said plurality of support members comprises a unitary structure.

4. The priming element of claim 3, wherein said unitary structure comprises a flexible and resilient material.

5. The priming element of claim 1, wherein said second wall member defines a second contacting surface substantially co-planar with the contacting surface of said first wall member, said plurality of support members being recessed from the second contacting surface.

6. The priming element of claim 5, wherein said plurality of support members connect said second wall member to said first wall member at a point to thereby define a space between said plurality of support members and the substantially co-planar surfaces of said first and second wall members.

7. The priming element of claim 6, wherein the space is an elongated slot.

8. A thermal ink jet printer comprising:

a priming element, said priming element including a first wall member defining a contacting surface, a second wall member spaced a distance from said first wall member, said first wall member and said second wall member together defining a passageway therebetween, and support means recessed from the contacting surface, connecting said first wall member to said second wall member, wherein said support means comprises a plurality of spaced apart support members, each of said plurality of support members spanning the passageway and connecting said first wall member to said second wall member to maintain the passageway in an open condition, thereby permitting the flow of material therethrough.

9. The thermal ink jet printer of claim 8, wherein said second wall member defines a second contacting surface, said plurality of support members being recessed from the second contacting surface.

10. The thermal ink jet printer of claim 9, wherein said first wall member, said second wall member, and said plurality of support members comprises a unitary structure.

11. The thermal ink jet printer of claim 10, wherein said unitary structure comprises a flexible and resilient material.

12. The thermal ink jet printer of claim 8, wherein said second wall member defines a second contacting surface substantially co-planar with the contacting surface of said first wall member, said plurality of support members being recessed from the second contacting surface.

13. The thermal ink jet printer of claim 12, wherein said plurality of support members connect said second wall member to said first wall member at a point to thereby define a space between said plurality of support members and the substantially co-planar surfaces of said first and second wall members.

14. The thermal ink jet printer of claim 13, wherein the space is an elongated slot.

* * * * *